United States Patent [19]

Osuga et al.

[11] Patent Number: 4,825,838

[45] Date of Patent: May 2, 1989

[54] AIR/FUEL RATIO CONTROL APPARATUS FOR AN INTERNAL COMBUSTION ENGINE

[75] Inventors: Minoru Osuga; Yoshishige Oyama, both of Katsuta, Japan

[73] Assignee: Hitachi, Ltd., Tokyo, Japan

[21] Appl. No.: 167,118

[22] Filed: Mar. 11, 1988

[30] Foreign Application Priority Data

Mar. 14, 1987 [JP] Japan ..... 62-59735

[51] Int. Cl.[4] ..... F02D 41/14

[52] U.S. Cl. ..... 123/489; 123/440

[58] Field of Search ..... 123/415, 440, 488, 489, 123/478, 480; 204/424, 425, 426, 427

[56] References Cited

U.S. PATENT DOCUMENTS

| | | | |
|---|---|---|---|
| 4,271,811 | 6/1981 | Suzuki et al. | 123/571 |
| 4,562,818 | 1/1986 | Kohama et al. | 123/415 |
| 4,566,419 | 1/1986 | Ninomiya et al. | 123/489 |
| 4,601,273 | 7/1986 | Kitahara et al. | 123/489 X |
| 4,653,451 | 3/1987 | Kobayashi et al. | 123/489 |
| 4,676,213 | 6/1987 | Itsuji et al. | 123/489 X |
| 4,748,953 | 6/1988 | Osuga et al. | 123/489 X |
| 4,771,752 | 9/1988 | Nishimura et al. | 123/489 |

*Primary Examiner*—Willis R. Wolfe

*Attorney, Agent, or Firm*—Fay, Sharpe, Beall, Fagan, Minnich & McKee

[57] ABSTRACT

In an internal combustion engine, in which, during the lean-burn region of its operation, fuel supplied for the engine is controlled so as to make an actual air/fuel ratio follow a predetermined lean air/fuel ratio, an air/fuel ratio control apparatus detects the amplitude of a pulsating component in an output voltage of an oxygen sensor. The pulsating component is caused by the occurence of a misfire. The control apparatus corrects a reference for the sensor output voltage in a feedback control of the air/fuel ratio in accordance with the detected amplitude of the pulsating component, whereby the stable operation of the engine can be secured irrespective of the aged change of the stable combustion limit of the engine.

35 Claims, 10 Drawing Sheets

FIG. 7
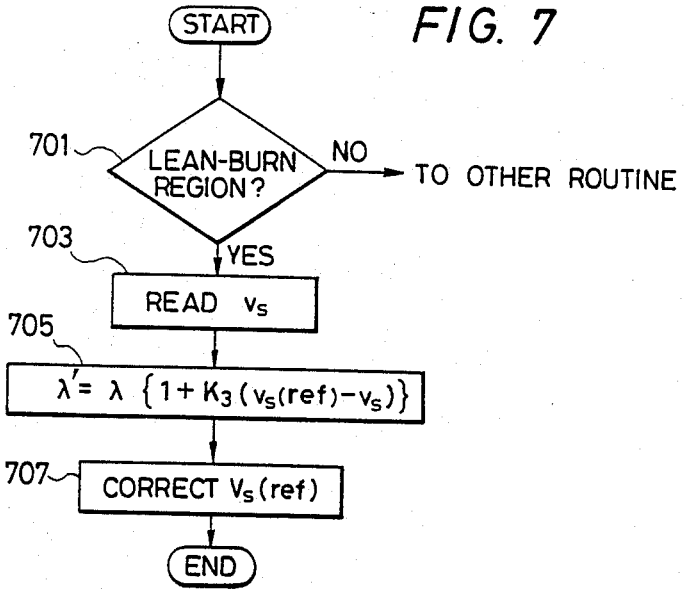
FIG. 8a
FIG. 8b
FIG. 8c
FIG. 8d
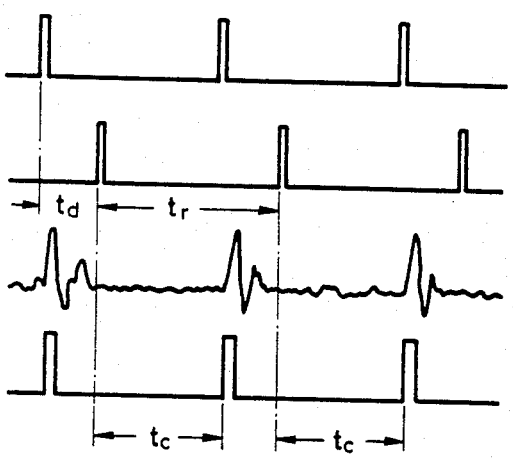
FIG. 8e
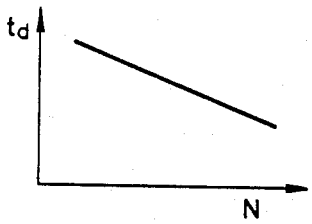

START
901
Tc = 0
903
j = 1
905
READ tc
907
Tc = Tc + tc
909
j ≧ J
911
j = j + 1
913
tc (ave) = Tc / J
915
READ tr
917
R = tc (ave) / tr
919
R ≦ R1
NO
YES
921
R ≦ R2
NO
YES
923
R ≦ R3
NO
YES
925
λ'1 = λ1 − C(λ)
927
λ'2 = λ2 − C(λ)
929
λ'3 = λ3 − C(λ)
931
λ'4 = λ4 − C(λ)
933
CORRECT Vs (ref)
END

AIR/FUEL RATIO CONTROL APPARATUS FOR AN INTERNAL COMBUSTION ENGINE

BACKGROUND OF THE INVENTION

1. Field of the Invention

The present invention relates to an air/fuel ratio control apparatus for an internal combustion engine, more particularly to a control apparatus capable of coping with the aged change of a stable combustion limit of an internal combustion engine.

2. Description of the Related Art

As is well known, in an internal combustion engine, as fuel mixture supplied for the engine becomes lean, the fuel consumption rate becomes small and an amount of carbon monoxide and hydrocarbon discharged is reduced accordingly. Nitrogen oxides discharged, which increase with an air/fuel (A/F) ratio of fuel mixture for a while, are also reduced after the A/F ratio exceeds a certain value, i.e., about 16 to 17. Therefore, in the field of automobiles in recent years, a lean-burn system has been put into practice, in which an internal combustion engine is operated with lean fuel mixture of A/F ratio of 18 to 19 or more. With this, the fuel consumption is reduced and the amount of noxious constituents in the exhaust gas is reduced to a great extent.

However, when fuel mixture becomes further lean, exceeding a certain limit, the combustion state of an engine is made worse, whereby the misfire is easy to occur, with the result that the stable operation of the engine is damaged. The aforesaid limit of the A/F ratio is called a stable combustion limit, hereinafter. The stable combustion limit is inherent to particular engines, which can be also subject to the aged change. Further, in the following description, a region, in which the A/F ratio is smaller than the stable combustion limit, will be called a stable combustion region, and a region, in which the A/F ratio exceeds the aforesaid limit, a misfiring region.

In the lean-burn system, therefore, a desired value of the A/F ratio of fuel mixture is set as close to the stable combustion limit as possible within the stable combustion region, and fuel mixture supplied for the engine must be controlled so as to make an actual A/F ratio follow the desired value. To this end, a usual lean-burn system may consist of, for example, providing an oxygen sensor to detect a real A/F ratio from the concentration of residual oxygen in exhaust gas and inputting an output signal of the oxygen sensor to a microprocessor to effect a feedback control of the A/F ratio so that a desired lean A/F ratio is achieved.

The stable combustion limit of an engine is subject to the aged change to be shifted toward a rich side of the A/F ratio, or, in some cases, toward a lean side. If the stable combustion limit of an engine changes toward a rich A/F ratio side, an A/F ratio of fuel mixture then supplied may be too lean for the engine to continue the stable operation without misfiring. On the contrary, if the stable combustion limit changes toward a lean A/F ratio side, then the engine may be supplied with fuel mixture which is richer than necessary, with the result that the fuel consumption is deteriorated.

To avoid these disadvantages, therefore, it is necessary in the lean-burn system to monitor the change in the stable combustion limit and to change the desired value of the A/F ratio to a new valve commensurate with a new stable combustion limit. The change of the desired A/F ratio has heretofore been carried out by detecting the change in the combustion state of an engine on the basis of parameters, such as change in torque produced by the engine, that in internal pressure of cylinders thereof or that in the number of revolutions thereof, as disclosed in U.S. Pat. No. 4,562,818 (patented Jan. 7, 1986).

However, the parameters as mentioned above are easily affected by external factors, such as inertia of an engine caused by pistons, connecting rods and the like, and inertia and vibration system of a car body, making it difficult to detect the change in the combustion state separately from the influence of the above mentioned external factors. As a result, the precision of detecting the change of the stable combustion limit and therefore the accuracy of a desired A/F ratio control is sacrificed for the above mentioned external factors.

SUMMARY OF THE INVENTION

It is an object of the present invention to provide an air/fuel ratio control apparatus for an internal combustion engine, which is capable of precisely detecting the aged change of a stable combustion limit of the engine and changing a desired value of an A/F ratio in accordance with the detected change of the stable combustion limit, whereby the engine is supplied with fuel mixture of an A/F ratio commensurate with the combustion condition of the engine at that time.

A feature of the present invention resides in that in an internal combustion engine the combustion state thereof is detected on the basis of a combustion state signal, which can be derived from an oxygen sensor provided in an exhaust pipe of the engine and depends on an amount of unburnt gas discharged from the engine, and a reference value for an output voltage of the oxygen sensor, which is set for a feedback control of the A/F ratio, is corrected in accordance with a detected value of the combustion state signal.

In embodiments of the present invention, as the combustion state signal, there are used a signal representing an amplitude of a pulsating component included in an output signal of an oxygen sensor or a signal in proportion to a heating current for heating the oxygen sensor to maintain its operating temperature at a predetermined constant value. The change of stable combustion limit is learnt when the aforesaid combustion state signal differentiates from its reference valve provided in advance.

According to this, since the signal as mentioned above depends on occurrence of the misfire in an engine much more directly and intimately than the factors used in the prior art, the change of the stable combustion limit of an engine can be precisely detected so that the appropriate feedback control of the A/F ratio of fuel mixture can be achieved.

Further, since the stable combustion limit changes toward a lean side in many cases, the correction of the reference of the sensor output voltage can be done only in such a case. If, however, the aforesaid correction is carried out also when the stable combustion limit changes toward a rich side, the fuel consumption will be further improved, because an engine is prevented from being supplied with fuel mixture which is unnecessarily rich.

The reference value of the sensor output voltage is corrected by changing a present value thereof in accordance with a predetermined correction amount. The correction amount can be determined in proportion to a difference between an actual value of the combustion state signal and its reference value. If, however, simplicity is required, it can also be set at a constant value irrespective of the aforesaid difference.

Further, there can be provided two kind of correction amounts, in which a first one for the case where the stable combustion limit changes toward the lean side can be made different from a second one for the case where it changes toward the rich side. Preferably, in this case, the first correction amount is made larger than the second one, whether they are variable or constant.

Other features and advantages of the present invention will become apparent upon reading the specification and inspection of the drawings and will be particularly pointed out in the claims.

BRIEF DESCRIPTION OF THE DRAWINGS

FIG. 7 is a flow chart showing a processing task executed by the microprocessor in FIG. 1 for correcting the reference of the sensor output voltage $V_s$ in accordance with another embodiment of the present invention;

FIGS. 8*a* to 8*e* are time charts for explaining a manner of identifying a cylinder in which the misfire occurs;

DESCRIPTION OF THE PREFERRED EMBODIMENTS

Although there are at first described some embodiments, in which a signal relating to a pulsating component included in an output voltage of an oxygen sensor is used for a combustion state signal, an operational principle underlying those embodiments will be explained before the detailed description thereof.

Figure 2:
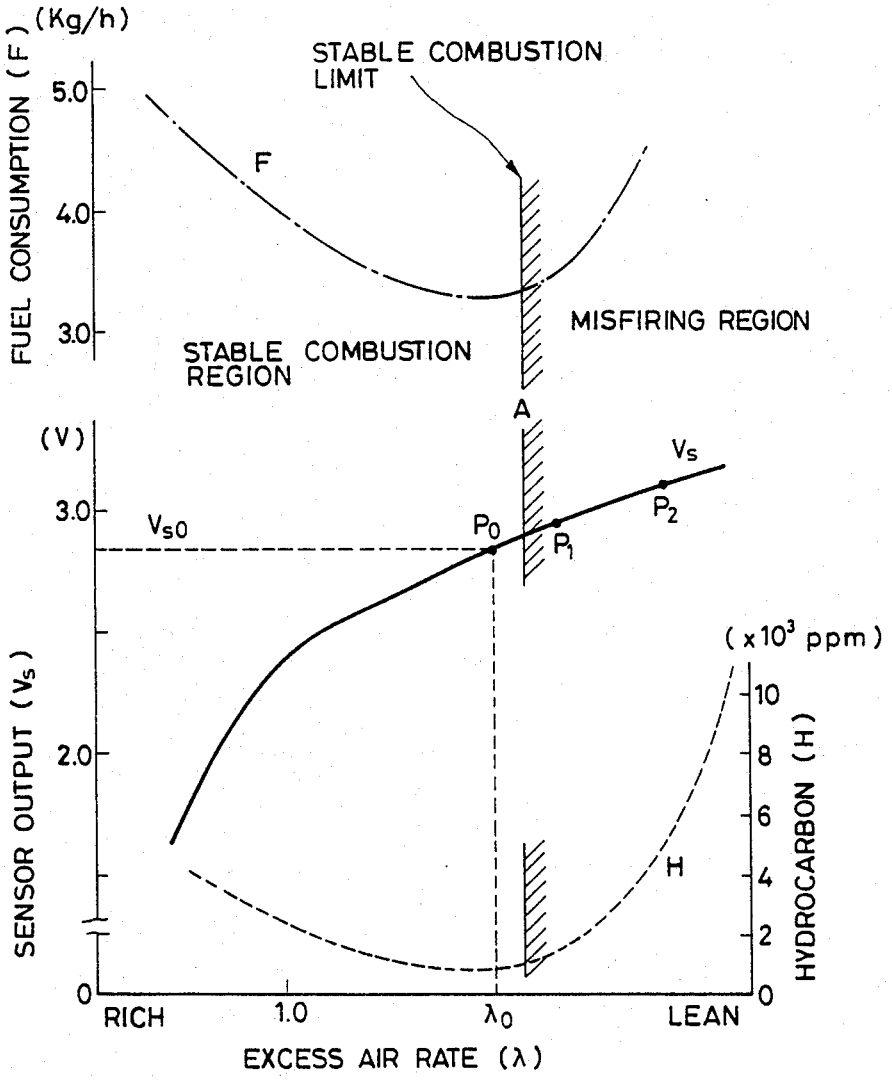
FIG. 2 is a diagram for explaining a problem caused by the change of a stable combustion limit of an engine, in which there are shown the changes in the fuel consumption F, the output voltage $V_s$ of an oxygen sensor and the concentration H of hydrocarbon discharged, with respect to an A/F ratio as represented by an excess air rate λ.

Referring to FIG. 2, there will be discussed briefly a lean-burn system in an internal combustion engine. In the figure, there are shown the change in the fuel consumption F and the concentration H of hydrocarbon included in exhaust gas and an output characteristic curve $V_s$ of an oxygen sensor provided in an exhaust pipe, with respect to an A/F ratio as represented by an excess air rate λ, which is a rate of a real value of the A/F ratio to a stoichiometric value (14.7) thereof. Also in the following, the A/F ratio is represented by the excess air rate λ.

Further, in FIG. 2, a line A with hatching represents a stable combustion limit of an internal combustion engine. A region on the left-hand side with respect to the line A is a stable combustion region, in which an engine can operates stably. On the contrary, a region on the right-hand side with respect of the line A is a misfiring region, in which the engine easily misfires.

As apparent from the figure, the fuel consumption F is reduced in the stable combustion region as the fuel mixture becomes lean, however it increases again steeply when an engine is operated in the misfiring region. There is a minimal point of the fuel consumption F near the stable combustion limit A. Therefore, if an engine is operated with fuel mixture of the excess air rate $\lambda_0$ close to the stable combustion limit A, the most economical operation thereof is attainable. The similar tendency appears also in the change of the concentration H of hydrocarbon discharged. If, therefore, an engine is operated with the excess air rate of fuel mixture maintained at $\lambda_0$, the amount of hydrocarbon discharged can be also minimized.

In the A/F ratio control for a lean-burn system of an internal combustion engine, a desired excess air rate $\lambda_0$ is set very close to the stable combustion limit A within the stable combustion region. The desired excess air rate is usually set at 18 to 19 or more in terms of the A/F ratio. Under the excess air rate $\lambda_0$, an oxygen sensor operates at point $P_0$ on the output characteristic curve $V_s$ and produces an output voltage $V_{s0}$, as shown in FIG. 2. Therefore, $V_{s0}$ is determined as a reference of sensor output voltage $V_s$ for a feedback control of the A/F ratio. Fuel supplied for the engine is regulated by the feedback control so as to make an actual output voltage $V_s$ of the oxygen sensor follow its reference $V_{s0}$ determined as above. With this, both the consumption of fuel and the amount of hydrocarbon discharged are much reduced.

Next, there will be given the description of the detection of the change of the stable combustion limit. If the excess air rate λ of fuel mixture supplied for an engine is so large as to exceed the stable combustion limit A of the engine at that time, as shown by point $P_1$ or $P_2$ on the output characteristic curve $V_s$ in FIG. 2, the engine induces the misfire, and an unburnt mixture is discharged therefrom. Hydrocarbon as mentioned above is included in the unburnt mixture discharged. If, therefore, the misfire occurs frequently, not only is the fuel consumption made worse, but also the amount of hydrocarbon discharged is increased.

If the misfire is repeated more frequently, the amount of unburnt mixture discharged is increased as much. Therefore, the unburnt mixture discharged can be used as a significant indicator for detecting the degree of misfiring, e.g., frequencies of occurrence of the misfire during a certain time period and/or a number of misfiring cylinders. Further, in the region of these excess air rates, the amount of other constituents other than hydrocarbon, such as carbon monoxide and nitrogen oxides, is very small, and therefore those constituents are not necessary to be taken into consideration for this purpose.

Here it is to be noted that the unburnt mixture discharged includes air as well as unburnt fuel. Namely, the concentration of residual oxygen in exhaust gas temporarily becomes high every time of occurrence of the misfire. This change in the residual oxygen concentration can be detected by an oxygen sensor provided in an exhaust pipe. Therefore, the change in the unburnt gas discharged can be determined by monitoring the change in an output voltage of the oxygen sensor, which originally detects the residual oxygen concentration.

By the way, assuming, for example, that one of cylinders of a four cycle, four cylinder engine repeats misfiring, the misfire occurs for almost every two revolutions of the engine, so that the unburnt mixture is discharged abundantly in synchronism therewith. Namely, the amount of unburnt mixture discharged pulsates while the cylinder continues to misfire, and therefore the output voltage of the oxygen sensor also pulsates. An amplitude of a pulsating component of the sensor output voltage depends very closely on the degree of misfiring.

Figure 3A:
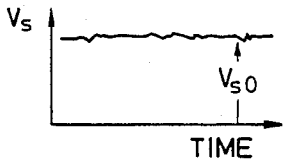
FIGS. 3*a* to 3*d* are drawings for explaining the pulsation in the output voltage $V_s$ of the oxygen sensor and the relationship of an amplitude $v_s$ of the pulsation thereof, with respect to the excess air rate λ.
Figure 3B:
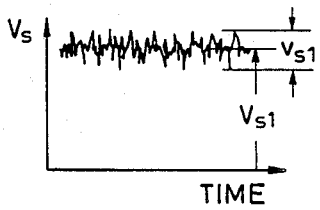
Figure 3C:
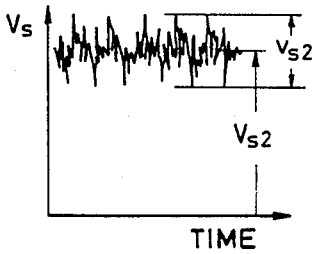

This will be explained in detail with reference to FIGS. 3*a* to 3*d*. If the oxygen sensor operates at point $P_0$ (cf. FIG. 2), i.e., in the stable combustion region, the sensor output voltage $V_{s0}$ does not include the pulsating component, as shown in FIG. 3*a*. When the sensor operates at point $P_1$ (cf. FIG. 2), i.e., in the misfiring region, but relatively close to the stable combustion limit A, the sensor output voltage $V_{s1}$ includes the pulsating component having the amplitude $v_{s1}$, as shown in FIG. 3*b*. Further, if the sensor operates at point $P_2$ (cf. FIG. 2), which is farther than $P_1$ from the stable combustion limit A, the sensor output voltage $V_{s2}$ includes the larger pulsating component having the amplitude $v_{s2}$, as shown in FIG. 3*c*.

Figure 3D:
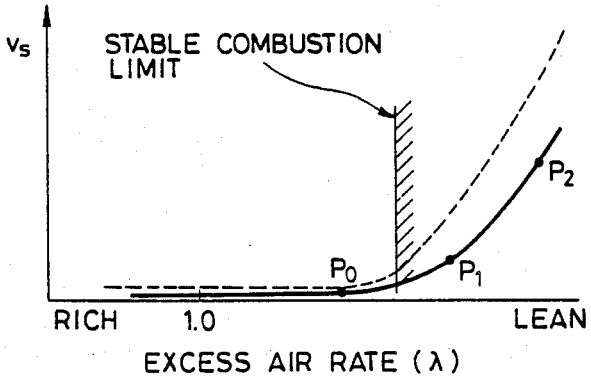

Accordingly, the relationship as shown by a solid curve in FIG. 3*d* can be observed between the amplitude vs of the pulsating component of the sensor output voltage $V_s$ and the excess air rate $\lambda$. The amplitude $v_s$ increases proportionally to the excess air rate $\lambda$ when it exceeds the stable combustion limit A. In FIG. 3*d*, a broken curve represents the amplitude of a pulsating component of hydrocarbon discharged. It will be understood from the foregoing description that, as shown in the figure, the change in the amplitude of the pulsating component of hydrocarbon discharged indicates the same tendency as the change in the amplitude $v_s$ of the pulsating component of the sensor output voltage $V_s$.

Some of the embodiments of the present invention, as described herein, use the relationship of $v_s$ as shown in FIG. 3*d*. In the following, the operational principle underlying those embodiments will be explained with reference to FIG. 4.

As already described, the stable combustion limit A may change toward the rich side as shown by line B or, in some cases, toward the lean side as shown by line C. At first, let us assume that the present stable combustion limit of an engine is as shown by line A and $\lambda_0$ is set as a desired excess air rate. At that time, $V_{s0}$ corresponding to $\lambda_0$ is determined as reference $V_s$(ref) of the sensor output voltage $V_s$. A control apparatus for a lean-burn system controls the A/F ratio of fuel mixture so as to make an actual output voltage $V_s$ to follow its reference $V_s$(ref).

If the stable combustion limit is changed from line A to line B, then the relationship of $v_s$ to the excess air rate $\lambda$ also changes from curve A' to curve B'. As a result, the desired excess air rate $\lambda_0$, which has been set under the stable combustion limit A, falls into the misfiring region under the stable combustion limit B.

Therefore, a new desired excess air rate $\lambda_b$ must be set, which lies in the stable combustion region under the stable combustion limit B. The determination of the desired excess air rate $\lambda_b$ is carried out as follows. An amplitude $v_{s0}$ of the pulsating component of a sensor output voltage $V_{s0}$ under the stable combustion limit A is held in advance as a reference $V_s$(ref). An amplitude of the pulsating component of the sensor output voltage $V_{s0}$ at that time is at first detected. The then detected amplitude is $v_{sb}$, because the excess air rate still remains at $\lambda_0$, notwithstanding that the relationship of $v_s$ to $\lambda$ has changed from curve A' to curve B'.

Then, the difference $\Delta v_{sb}$ between $v_{sb}$ and $v_s$(ref) is obtained. The desired excess air rate $\lambda_0$ is corrected on the basis of the above obtained $\Delta v_{sb}$, e.g., in proportion to $\Delta v_{sb}$, whereby a new desired excess air rate $\lambda_b$ is determined. Further, $V_{sb}$ corresponding to $\lambda_b$ is determined as a new reference of the sensor output voltage $V_s$ for the feedback control of the A/F ratio.

Figure 4:
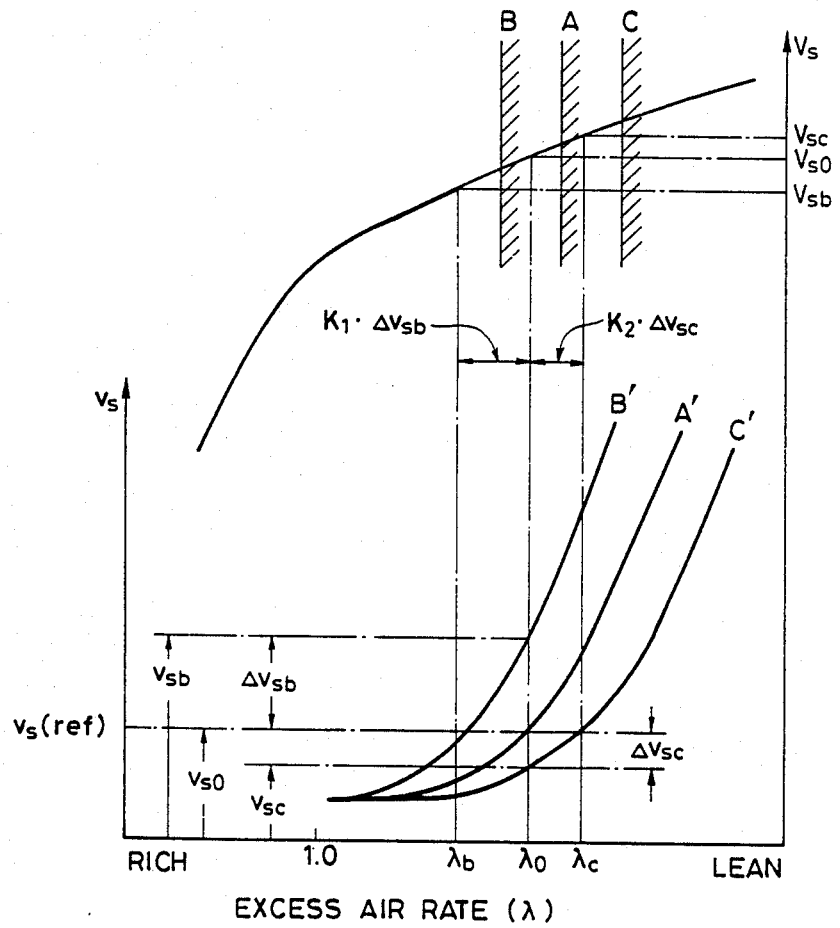
FIG. 4 is a drawing for explaining the principle of the correcting operation of a reference value for the sensor output voltage $V_s$ in a feedback control of the A/F ratio, in order to cope with the aged change in a stable combustion limit of an engine.

The stable combustion limit may also change toward the lean side as shown by line C in FIG. 4. At that time, the relationship of $v_s$ to the excess air rate $\lambda$ becomes as shown by curve C'. As apparent from comparison of curves A' and C', a desired excess air rate can be set at a somewhat large value under the stable combustion limit C, compared with $\lambda_0$ set under the stable combustion limit A. Nevertheless, if an engine continues to be operated with the excess air rate maintained at $\lambda_0$, the engine consumes more than the necessary amount of fuel as a result.

Therefore, a new desired excess air rate should be set commensurately with the change of the stable combustion limit. Also in this case, the resetting of the desired excess air rate can be carried out in the same manner as described above.

An amplitude $v_s$ of the pulsating component at that time is as first detected. The then detected amplitude $v_s$ is equal to $v_{sc}$, because the excess air rate is still at $\lambda_0$, notwithstanding that the relationship of $v_s$ to $\lambda$ has changed from curve A' to curve C'. Then, there is obtained a difference $\Delta v_{sc}$ between $v_{sc}$ and the already held $v_s$(ref). The desired excess air rate $\lambda_0$ is changed to a new desired excess air rate $\lambda_c$ on the basis of the above obtained $\Delta v_{sc}$. Further, $V_{sc}$ corresponding to $\lambda_c$ is determined as a new reference $V_s$(ref) of the sensor output voltage $V_s$.

Figure 1:
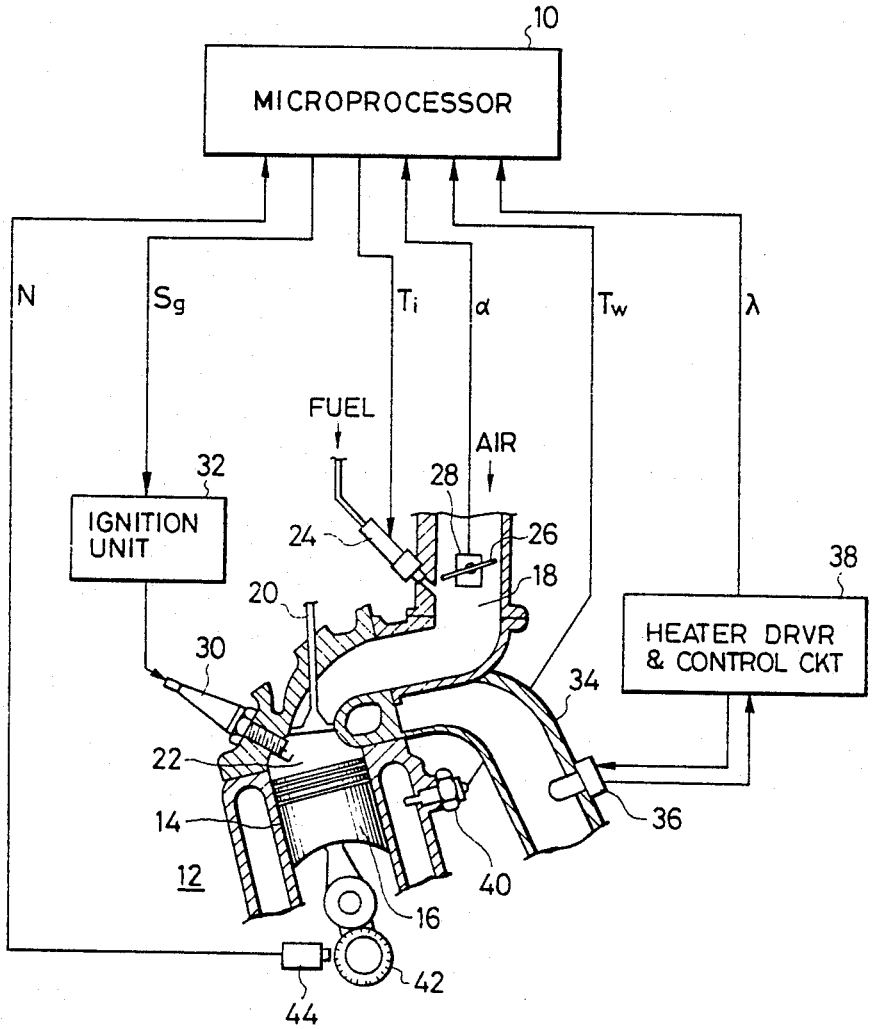
FIG. 1 schematically shows an overall structure of an A/F ratio control apparatus, in which there is included a microprocessor characterized by the present invention.

Referring next to FIG. 1, there is explained an overall structure of an A/F control apparatus, which comprises a microprocessor 10 for executing the signal processing operation characterized by the present invention. The aforesaid processing operation can be included as one of the tasks which must be carried out by a known type of microprocessor 10 for controlling an internal combustion engine.

The configuration per se of the microprocessor 10 is known, i.e., it has a central processing unit (CPU) for executing programs for the predetermined tasks, a read only memory (ROM) for storing the programs and various fixed data necessary for the execution of the programs, and a random access memory (RAM) for temporarily storing various data. There are further provided various input/output interfaces for coupling the microprocessor 10 with such sensors or control devices as described later. These components are interconnected with each other by bus lines provided within the microprocessor 10. The signal processing operation of the microprocessor 10, which is characterized by the present invention, will be described in detail later.

In FIG. 1, engine 12 is represented by a single cylinder 14 and piston 16. With the engine 12 there is coupled an intake pipe 18, at one end of which there is provided an intake valve 20. When the valve 20 is opened, the fuel mixture is introduced into combustion chamber 22 through the intake pipe 18. The intake pipe 18 is coupled at the other end thereof with an air filter (not shown).

The intake pipe 18 is provided with fuel injection valve 24 and throttle valve 26. The injection valve 24 is supplied with pressure-regulated fuel and therefore the amount of fuel injected is exactly in proportion to the opening time duration thereof, which is determined by a signal $T_i$ applied thereto from the microprocessor 10. To the throttle valve 26 there is attached a throttle sensor 28, which produces a signal $\alpha$ representative of the opening degree of the throttle valve 26 to the microprocessor 10.

An airflow sensor is not included in FIG. 1. This is because the engine 12 is of the type, in which an amount of fuel to be injected is determined on the basis of the opening degree of the throttle valve 26 and a number of revolutions of the engine 12. However, the present invention is not confined by the type of engine it is applied to, but can of course be applied to an engine of the type, in which an amount of fuel to be injected is determined on the basis of a quantity of suction air and a number of revolutions. In that case, instead of or in addition to the throttle sensor 28, there will be provided an airflow meter upstream of the throttle valve 26, which detects the quantity of suction air and an output signal of which is coupled to the microprocessor 10.

The engine 12 is further provided with ignition plug 30, to which high voltage is applied by ignition unit 32 at the timing of a signal $S_g$ given to the unit 32 from the microprocessor 10. Thereby, the fuel mixture introduced into the combustion chamber 22 is burnt and exhaust gas is discharged to exhaust pipe 34 when an outlet valve (not shown) is opened.

At an appropriate position of the exhaust pipe 34 there is equipped oxygen sensor 36, which is of a known type comprising a solid electrolyte such as zirconia oxide. The sensor 36 is heated to a temperature of about 800° C. by heater driver and control circuit 38. An output of the sensor 36 is transmitted through the circuit 38 to the microprocessor 10 as a signal $\lambda$ representative of a detected value of the excess air rate.

Crank shaft 42 of the engine 12 is provided with crank angle sensor 44, which produces a signal N representing a number of revolutions of the engine 12 to the microprocessor 10. The engine 12 is further provided with temperature sensor 40 on wall of the cylinder 14, which detects the temperature of the cooling water of the engine 12 to produce an output signal $T_w$ representing the detected temperature to the microprocessor 10.

In the structure shown, in the same manner as a known microprocessor for an engine control apparatus, the microprocessor 10 receives the signals $\alpha$ and N from the throttle sensor 28 and the crank angle sensor 38, respectively, and executes the predetermined processing on the basis of the received signals to produce an injection pulse signal $T_i$ to the injection valve 24. Assuming that a basic amount of fuel to be injected is represented by $Q_f$, the aforesaid processing is carried out in accordance with the relationship $Q_f = f(\alpha, N)$.

The thus determined basic amount of fuel to be injected is corrected in accordance with the signal $\lambda$ of the actually detected A/F ratio given from the oxygen sensor 36 through the control circuit 38. The water temperature $T_w$ signal from the sensor 40 may also be taken into consideration for the correction of the amount of fuel to be injected. The signal of the corrected amount of fuel to be injected is applied to the injection valve 24 as the signal $T_i$. The ignition timing signal $S_g$ for the ignition unit 32 is determined in accordance with the basic amount of fuel to be injected.

The function of the microprocessor 10, as mentioned above, is disclosed in U.S. patent Application Ser. No. 030,432 (filed Mar. 26, 1987, now U.S. Pat. No. 4,771,752, and assigned to the assignee of the present application) entitled A CONTROL SYSTEM FOR INTERNAL COMBUSTION ENGINES, for example. Further, as described above, the present invention is not confined by the manner of determining the amount of fuel to be injected. Therefore, the further description of this function of the microprocessor 10 is omitted here.

Referring next to a flow chart of FIG. 5, there will be explained the task executed by the microprocessor 10 in accordance with an embodiment of the present invention. This task is not necessary to be carried out so frequently, because the aged change of the stable combustion limit of an engine does not occur so frequently, but little by little extending over a long term. Therefore, a considerably low priority can be given to this task, among all of the tasks which must be executed by the microprocessor 10. This task is sufficient to be executed every about 150 milliseconds, for example.

The processing operation of this task is carried out when an engine operates in a lean-burn region. Even an internal combustion engine, which adopts a lean-burn system, must be operated with rich fuel mixture in a full load region, i.e., when heavy load is put on the engine. The engine is operated with rich fuel mixture also in a high speed region, i.e., when the engine is required to rotate at high speed. Accordingly, this processing operation must be executed in the lean-burn region, in which the engine is operated with lean fuel mixture.

Therefore, after start of this task, it is at first judged at step 501 whether or not the engine 12 operates in the lean-burn region. This judgment is carried out on the basis of the opening degree of the throttle valve 26 and the number of revolutions of the engine 12. If the operation state of the engine 12 is not in the lean-burn region, the operation by the microprocessor 10 is transferred to the execution of a routine for other tasks, and the processing operation of this task ends.

If the engine 12 operates in the lean-burn region, the amplitude $v_s$ of the pulsating component of the sensor output voltage $V_s$ is read at step 503. The amplitude $v_s$ is obtained by the following method and stored in advance in the microprocessor 10. Namely, since the sensor output voltage $V_s$ includes a base (direct current) component and a pulsating component, as shown in FIGS. 3*a* to 3*c*, the direct current component is at first eliminated, for example, by a capacitor. Then, the extracted pulsating component is subject to full-wave rectification, so that $v_s$ in proportion to the amplitude of the pulsation of $V_s$ can be obtained.

At step 505, it is judged whether or not $v_s$ read in step 503 is equal to or larger than the reference $v_s$(ref). The reference $v_s$(ref) is determined in advance in the manner as already described with reference to FIG. 4. If $v_s$ is equal to or larger than $v_s$(ref), the difference $\Delta v_s$ is obtained by subtracting $v_s$(ref) from $v_s$ at step 507. Then, at step 509, a new excess air rate $\lambda'$ is obtained by subtracting a correction amount $K_1 \cdot \Delta v_s$ proportional to the difference $\Delta v_s$ from a present excess air rate $\lambda$, wherein $K_1$ is a proportional constant.

If $v_s$ is smaller than $v_s$(ref), the difference $\Delta v_s$ is obtained by subtracting $v_s$ from $v_s$(ref) at step 511. Then, at step 513, a new excess air rate $\lambda'$ is obtained by adding a correction amount $K_2 \cdot \Delta v_s$ proportional to the difference $\Delta v_s$ to the present excess air rate $\lambda$, wherein $K_2$ is a proportional constant.

After the new excess air rate $\lambda'$ is obtained as described above, a reference $V_s$(ref) of the sensor output voltage $V_s$ is corrected at step 515, and this processing operation ends. The reference $V_s$(ref) can be easily obtained in accordance with the output characteristic curve of the oxygen sensor 36 on the basis of the new excess air rate $\lambda'$.

The constants $K_1$ and $K_2$ in steps 509 and 513 may be equal to or different from each other. Preferably, however, $K_1$ is larger than $K_2$. This is because it is desirable to correct reference $V_s$(ref) quickly, e.g., by one time of the correcting operation, when the change of the stable combustion limit toward the rich side is detected.

On the contrary, when the stable combustion limit changes toward the lean side, it is preferred that $V_s$(ref) be corrected rather slowly, i.e., by several times of the correcting operations, so that an excess air rate to be newly set never falls into the misfiring region under the changed stable combustion limit.

Further, in the foregoing embodiment, the correction amounts were both determined in proportion to the difference $\Delta v_s$ between $v_s$ and $v_s$(ref). If, however, simplicity of control is required, constant values, which are determined empirically in advance, can be used as the correction amounts irrespective of the difference $\Delta v_s$. In this case, it is preferred that a value of the correction amount for the case where the stable combustion limit changes toward the rich side be larger than that of the correction amount for the case where it changes toward the lean side.

Figure 6:
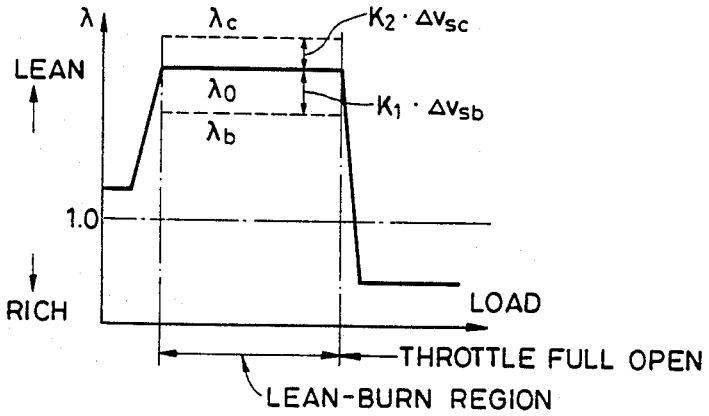
FIG. 6 is a diagram showing a map of a desired excess air rate λ with respect to load put on an engine.

In FIG. 6, there is shown the result of the aforesaid task on a map of the excess air rate. In the figure, the abscissa represents load put on an engine, which can be measured by negative pressure within the intake pipe 18. Usually there are provided several patterns of maps in the microprocessor 10, which are different in accordance with the number of revolutions of the engine 12 as a parameter.

A pattern of the map for a certain number of revolutions of the engine 12 is shown by a solid line in the figure. In the usual operation of the A/F ratio control, the microprocessor 10 retrieves a desired excess air rate $\lambda$ in accordance with the load from this map and controls the A/F ratio of fuel mixture on the basis of the retrieved desired excess air rate $\lambda$. According to the present embodiment as described above, the desired excess air rate of the lean-burn region in the map is reset in accordance with the deviation of the amplitude $v_s$ of the pulsating component of the sensor output voltage $V_s$ from its reference $v_s$(ref), as shown by broken lines $\lambda_b$ and $\lambda_c$ in the figure.

The reference $V_s$(ref) of the sensor output voltage $V_s$ is corrected on the basis of the thus reset $\lambda_b$ and $\lambda_c$ values. Therefore, when it has been detected that the stable combustion limit changes toward the rich side, the excess air rate $\lambda_b$, which is smaller than the original rate $\lambda_0$, is newly set accordingly, and the feedback control of the A/F ratio of fuel mixture is carried out by using the reference $V_s$(ref) of the sensor output voltage $V_s$, which is corrected on the basis of the smaller rate $\lambda_b$. As a result, the engine 12 is supplied with richer fuel mixture, and occurrence of the misfire can be suppressed. On the contrary, in the case where the stable combustion limit changes toward the lean side, the engine 12 is supplied with leaner fuel mixture on the basis of the larger excess air rate $\lambda_c$ and therefore the reference $V_s$(ref) is set commensurate therewith, whereby the fuel consumption is improved.

Figure 5:
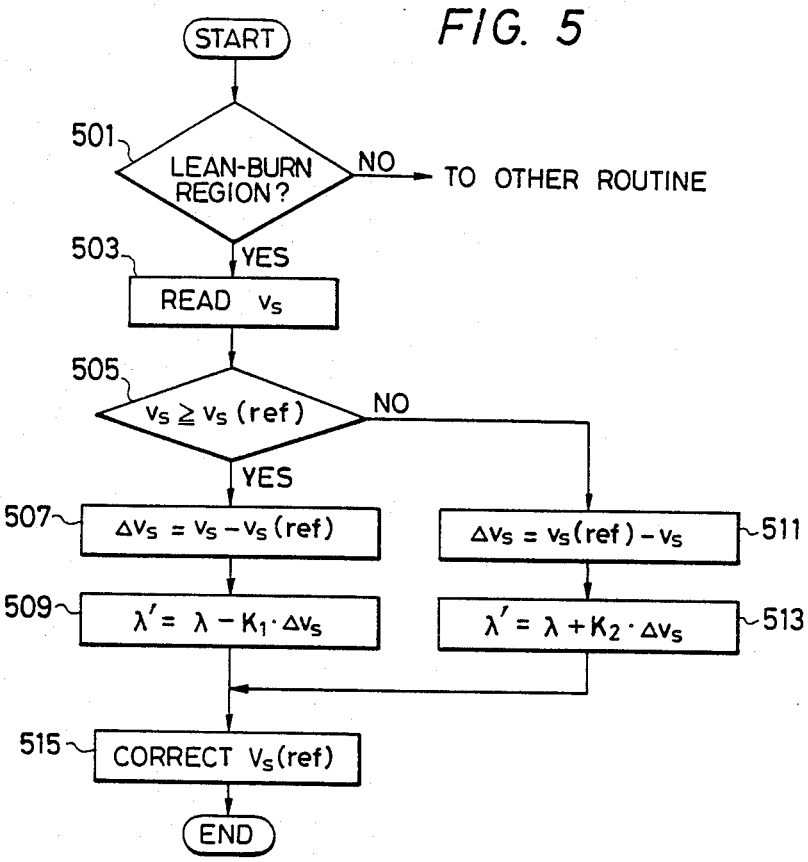
FIG. 5 is a flow chart showing a processing task executed by the microprocessr in FIG. 1 for correcting the reference of the sensor output voltage $V_s$ in accordance with an embodiment of the present invention.

In the flow chart of FIG. 5, the correcting operation of the reference $V_s$(ref) has been carried out with the feedback control of the A/F ratio being effective. In this case, the influence of this feedback control may more or less appear on the sensor output voltage $V_s$, with the result that it may become difficult to catch the change of the amplitude $v_s$ of the pulsating component absolutely free from the aforesaid influence.

Then, the following modification can be considered on the embodiment described above. Before reading $v_s$ at step 503, there is provided a step of giving an instruction, by which the feedback control loop of the A/F ratio is opened. Under the opened loop of the A/F ratio control, the resetting of a desired value of the excess air rate $\lambda$ and the correcting operation of a reference $V_s$(ref) in accordance therewith, as described above, are carried out, and after $V_s$(ref) has been corrected at step 515, the control loop is closed again. Accordingly, the reference $V_s$(ref) can be corrected precisely without any influence of the feedback control.

In the embodiments described above, the resetting of a desired excess air rate, i.e., the calculation of $\lambda'$, has been carried out by separate routes, i.e., steps 507, 509 and steps 511, 513, in response to the relationship between $v_s$ and $v_s$(ref). The setting of a new desired excess air rate $\lambda'$ can be done in a simpler manner. FIG. 7 shows a flow chart of a processing task executed by the microprocessor 10 according to another embodiment of the present invention, in which a new excess air rate $\lambda'$ is determined in a simpler manner.

In the figure, steps 701, 703 and 707 perform the same functions as steps 501, 503 and 515 in FIG. 5, respectively, and therefore the detailed description thereof is omitted. A new desired excess air rate $\lambda'$ is obtained in accordance with a formula indicated in step 705. As apparent from the formula, the new desired excess air rate λ' is calculated on a difference between $v_s$(ref) and $v_s$, in which the sign, i.e., positive or negative, of the difference is taken into consideration.

Namely, if $v_s$ is larger than $v_s$(ref), the difference becomes negative and the new desired excess air rate λ' is made smaller than the present rate λ. On the contrary, if $v_s$ is smaller than $v_s$(ref), the difference becomes positive and the new desired excess air rate λ' is made larger than the present rate λ.

By the way, if a particular cylinder, in which the misfire occurs, can be identified, it is preferable that only a desired excess air rate λ for the identified cylinder is changed. If, for example, the stable combustion limit of a certain cylinder of an engine changes toward the rich side, the misfire occurs only in the cylinder and remaining cylinders may continue the stable combustion.

In such a case, the engine can continue to operate stably by making only the fuel mixture supplied to a misfiring cylinder rich. Nevertheless, if the fuel mixture supplied to all the cylinders is made rich, the fuel consumption increases unnecessarily and the amount of noxious gases exhausted also increases. In the following, there will be described a third embodiment, in which a misfiring cylinder is identified and only a desired excess air rate for the cylinder is reset.

Referring at first to FIGS. 8*a* to 8*e*, there is explained a method of identifying a misfiring cylinder. In these figures, a signal shown in FIG. 8*a* is a reference cylinder signal, which is periodically generated every two revolutions of an engine. This signal can be made from, for example, the crank angle signal produced by a crank angle sensor and indicates a combustion stroke of a reference cylinder, e.g., a first cylinder. On the basis of the reference cylinder signal, a signal as shown in FIG. 8*b* is generated taking into account of a delay $t_d$ of time, in which exhaust gas after the combustion in the reference cylinder reaches an oxygen sensor provided in an exhaust pipe. In FIG. 8*b*, time $t_r$ corresponds to one cycle of the periodic reference cylinder signal.

FIG. 8*c* shows the waveform of the pulsating component of the output voltage $V_s$ of the oxygen sensor. As shown in the figure, peak voltages appear in the sensor output voltage $V_s$ in synchronism with occurrence of the misfire. A pulse signal as shown in FIG. 8*d* is obtained by shaping the pulsating component of the sensor output voltage $V_s$ as shown in FIG. 8*c*. In the signal of FIG. 8*d*, time $t_c$ between the signal of FIG. 8*b* and the signal of FIG. 8*d* corresponds to the time between the combustion stroke of the reference cylinder and that of a misfiring cylinder. If, therefore, a rate of time $t_c$ for one cycle $t_r$ of the reference cylinder signal is obtained, a misfiring cylinder can be identified by the rate.

Further, the time delay $t_d$, as shown in FIG. 8*b*, during which exhaust gas after combustion in the reference cylinder reaches the oxygen sensor, varies in accordance with the velocity of the exhaust gas flowing through the exhaust pipe, which is in turn proportional to the number of revolutions of the engine. Therefore, it is necessary to change the time $t_d$ in accordance with the number N of revolutions of the engine, as shown in FIG. 8*e*.

Figure 9:
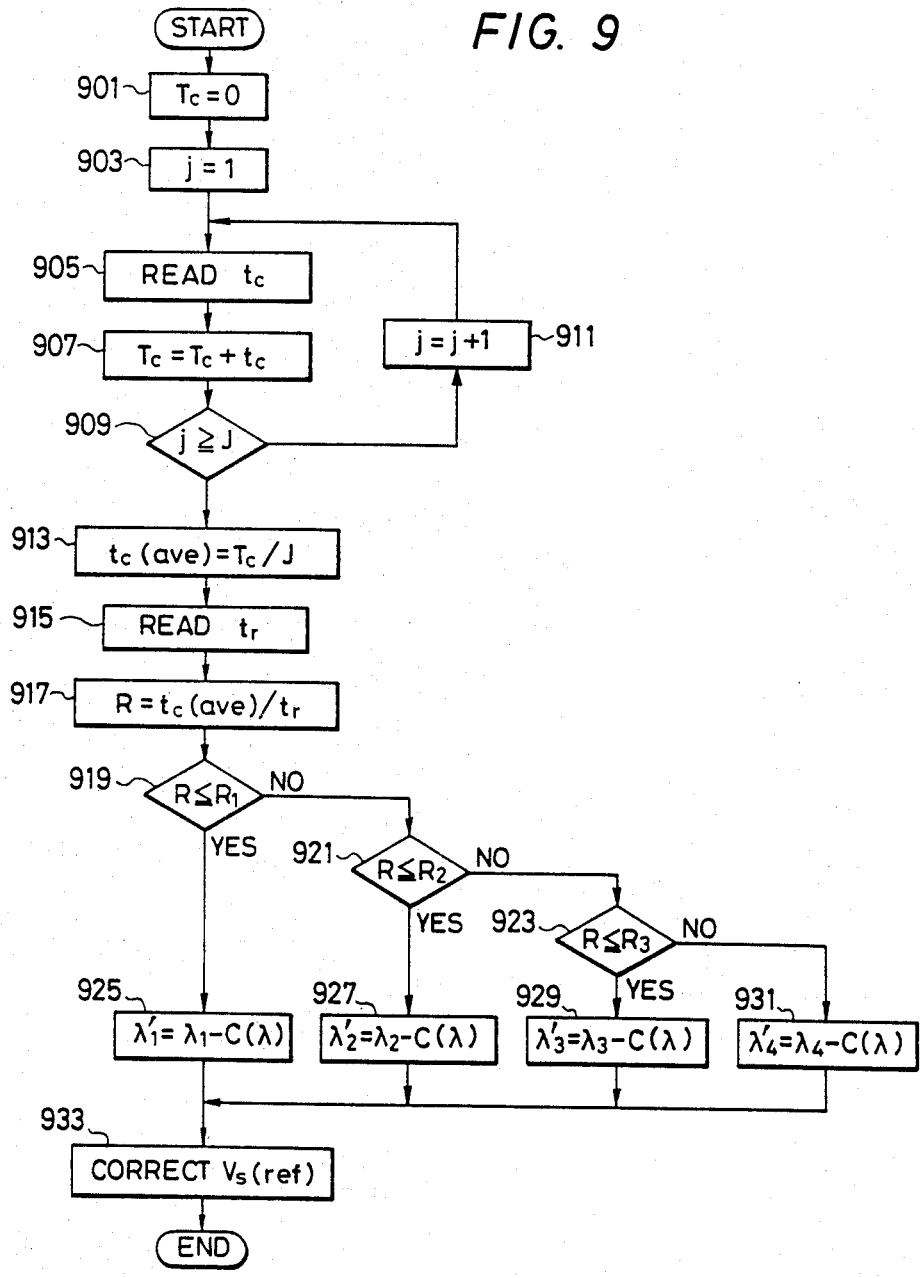
FIG. 9 is a flow chart showing a processing task executed by the microprocessor in FIG. 1 for correcting the reference of the sensor output voltage $V_s$ in accordance with a third embodiment of the present invention.

Referring to FIG. 9, there will be explained a processing task executed by the microprocessor 10 in accordance with the third embodiment. Further, it is assumed that the number of cylinders of the engine 12 is four.

In the embodiment, an average value of plural numbers J of time $t_c$ is used as the aforesaid time $t_c$ in order to secure the reliable identification of a misfiring cylinder. In the flow chart of FIG. 9, steps 901 to 913 are provided for that purpose.

At steps 901 and 903, the microprocessor 10 are initialized for the processing operation of this task. Namely, a memory area in the microprocessor 10 for storing a cumulative total $T_c$ of time $t_c$ is cleared at step 901, and a variable j is set at one in step 903. Thereafter, at step 905, a detected value of time $t_c$ is read, and at step 907 the detected time $t_c$ is added to a previous total $T_c$ and a new total $T_c$ is obtained. Next, it is judged at step 909 whether or not j exceeds J. If j is not equal to or greater than J, one is added to j at step 911, and the operation as mentioned above is repeated with time $t_c$ newly detected for every time of repetition, until j reaches J.

The thus obtained total $T_c$ is divided by J at step 913 so that the average value $t_c$(ave) is obtained. Then, one cycle $t_r$ is read at step 915 and the ratio or rate R of $t_c$(ave) to $t_r$ is calculated at step 917. In the present embodiment, because the engine 12 is a four cylinder engine, three references $R_1$, $R_2$ and $R_3$ for the rate R are provided for the purpose of identifying a misfiring cylinder, and the comparisons of at most three times are carried out between the calculated rate R and its references $R_1$, $R_2$ and $R_3$, as shown in steps 919, 921 and 923, whereby a misfiring cylinder can be identified.

Thereafter, at corresponding step 925, 927, 929 and 931, new desired excess air rates $\lambda_1'$, $\lambda_2'$, $\lambda_3'$ or $\lambda_4'$ are obtained by subtracting a constant correction amount C(λ) from a present desired excess air rate $\lambda_1$, $\lambda_2$, $\lambda_3$ or $\lambda_4$. Then, at step 933, a reference $V_s$(ref) for the sensor output voltage $V_s$ is corrected in accordance with the output characteristic curve of the oxygen sensor 36 on the basis of the new desired excess air rate $\lambda_1'$, $\lambda_2'$, $\lambda_3'$ or $\lambda_4'$ determined as above.

In the embodiment of FIG. 9, the new desired excess air rate $\lambda_1'$, $\lambda_2'$, $\lambda_3'$ or $\lambda_4'$ has been determined by subtracting the constant correction amount C(λ) from the present rate $\lambda_1$, $\lambda_2$, $\lambda_3$ or $\lambda_4$ without taking into account the degree of misfiring. However, by combining the present embodiment with either the embodiment of FIG. 5 or that of FIG. 7, the new desired excess air rate $\lambda_1'$, $\lambda_2'$, $\lambda_3'$ or $\lambda_4'$ can be determined on the basis of the correction amount depending on the degree of misfiring.

In this manner, according to the embodiment described above, only the excess air rate λ of fuel mixture supplied for a particular cylinder, the stable combustion limit of which has changed, is newly set. As a result, since all cylinders of an engine are not uniformly supplied with unnecessarily rich or lean fuel mixture, the fuel consumption is not deteriorated, or occurrence of the misfire in cylinders, the stable combustion limits of which do not change, can be prevented.

Figure 10:
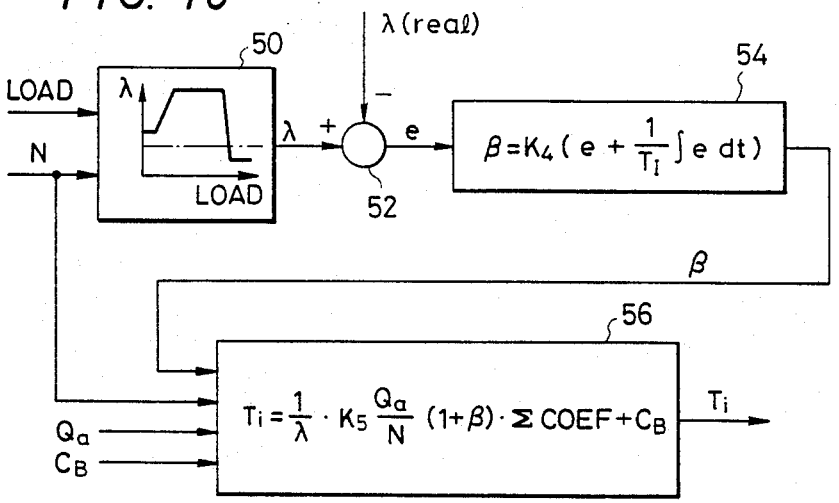
FIG. 10 is a functional block diagram for showing the operational principle of a fourth embodiment of the present invention.

In every embodiment described heretofore, the output voltage of an oxygen sensor has been directly used for detecting the change of the stable combustion limit of an engine. Referring next to FIG. 10, there will be described a fourth embodiment of the present invention, in which the sensor output voltage is indirectly used for the same purpose. Namely, a difference between a desired excess air rate λ and its actual value λ(real) detected by the oxygen sensor is used for detecting the change of the stable combustion limit. An A/F ratio control system according to the present embodiment is shown in FIG. 10 in the form of a functional block diagram.

In the block diagram, block 50 indicates a map, which has the same characteristics as shown in FIG. 6, and a desired excess air rate λ is obtained by retrieving it from the map of block 50 on the basis of the load and the number of revolutions. A difference e between λ and λ(real) is obtained in a subtracter 52. The difference e is passed through a proportional integral (PI) element (block 54) to be converted into one (β) of control factors for determining a fuel injection time $T_i$. In a formula of block 54, $K_4$ represents a constant and $T_1$ an integration time constant. Also block 54 can be a proportional integral and differential (PID) element. The element of block 54 can be selected in accordance with the necessity in control.

In block 56, the injection time $T_i$ is determined in accordance with a formula indicated in this block on the basis of the control factor β, the number N of revolutions, a quantity $Q_a$ of suction air and a correction coefficient $C_B$ for compensating the variation in a battery voltage. Further in the formula, $K_5$ denotes a constant and ΣCOEF various kind of correction coefficients. As ΣCOEF, there can be used a correction coefficient for the water temperature, a correction coefficient for an exhaust gas recirculation and a correction coefficient for fuel pressure and so on independently or in combination of some or all of them. Block 56 produces an injection pulse to the injection valve 24, the pulse width of which is in proportion to the thus obtained injection time $T_i$.

Figure 11:
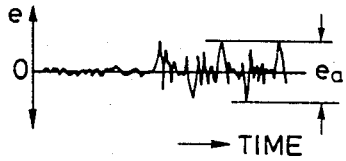
FIG. 11 is a drawing for explaining the operation of the fourth embodiment, in which there is shown the pulsation in a difference e between the reference of the excess air rate λ and the real value λ(real) thereof.
Figure 12:
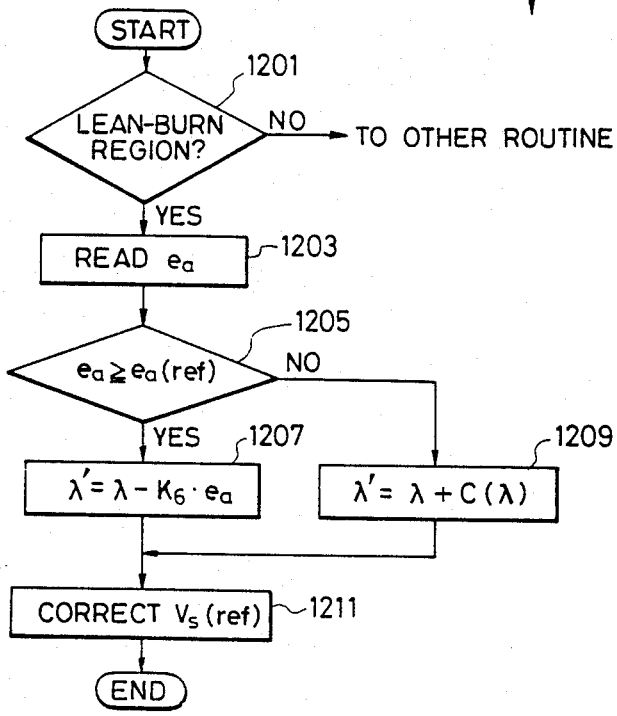
FIG. 12 is a flow chart showing a processing task executed by the microprocessor in FIG. 1 for correcting the reference of the sensor output voltage $V_s$ in accordance with the fourth embodiment.

It is to be noted here that, as already described, the actual excess air rate (real) detected by the oxygen sensor 36 pulsates upon occurrence of the misfire in the engine 12 in accordance with the degree thereof. Therefore, the difference e between λ and λ(real) also pulsates with the amplitude $e_a$ according to the degree of misfiring, as shown in FIG. 11. In the present embodiment, the amplitude $e_a$ of the pulsating difference e is used for correcting a reference $V_s$(ref) of the sensor output voltage $V_s$. FIG. 12 shows a flow chart of a processing task executed by the microprocessor 10 in accordance with the present embodiment.

At first, it is judged at step 1201 whether or not the operational state of the engine 12 is in the lean-burn region. If the judgment at this step is negative, the operation of the microprocessor 10 is transferred to the execution of a routine for other tasks, and the processing operation of this task ends. If the engine 12 operates in the lean-burn region, the amplitude $e_a$ is read at step 1203. The amplitude $e_a$ can be obtained in an analogous manner as already described, i.e., by rectifying the signal as shown in FIG. 11 by full-wave rectification. The thus obtained $e_a$ is compared with a reference $e_a$(ref) prepared therefor in advance at step 1205.

If it is discriminated that $e_a$ is equal to or larger than $e_a$(ref), this means that the stable combustion limit changes toward the rich side. At that time, the correction amount $K_6 \cdot e_a$ proportional to the read amplitude $e_a$ is subtracted from a present desired excess air rate λ, whereby a new desired excess air rate λ', which is smaller than λ, can be set (cf. step 1207). On the contrary, if $e_a$ is smaller than $e_a$(ref), this means that the stable combustion limit changes toward the lean side. Therefore, a new desired excess air rate λ' is obtained by adding a constant correction amount C(λ) to the present rate λ irrespective of the read amplitude $e_a$, whereby λ', which is larger than λ, can be reset (cf. step 1209). It is of course possible to use a constant correction amount instead of $K_6 \cdot e_a$ at step 1207 and a correction amount depending on the amplitude $e_a$ for setting the new excess air rate λ' at step 1209.

After the new desired excess air rate λ' has been determined in this manner, a reference $V_s$(ref) is corrected in accordance with the new desired excess air rate λ' at step 1211, and thereafter the processing operation of this task ends. According to the present embodiment, the correction of the reference $V_s$(ref) for the sensor output voltage $V_s$ can be achieved without making the feedback control loop of the A/F ratio open.

In the embodiments mentioned above, a combustion state signal has been obtained from the signals relating directly or indirectly to the output voltage of an oxygen sensor. In the following there will be described a fifth embodiment, in which a heating current of the oxygen sensor is used as the combustion state signal.

Figure 14:
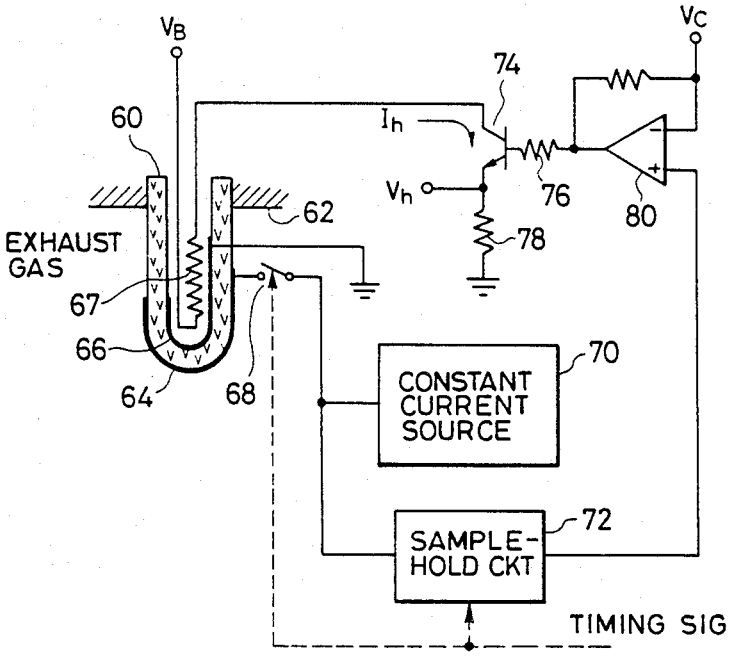
FIG. 14 schematically shows a configuration of a part of the fifth embodiment.

In FIG. 14 there is schematically shown the overall configuration of an oxygen sensor system used in the present embodiment. As shown in the figure, a sensing portion comprises hollow solid electrolyte 60 such as zirconia oxide, which is projected through wall 62 of the exhaust pipe 34 into the inside thereof. One end of the hollow solid electrolyte 60 is closed and the other end is open to the atmosphere. On both sides of the solid electrolyte 60 there are provided two electrodes 64 and 66. Although, as is well known, there are further provided a porous diffusion layer on the electrode 64 and a protective cover surrounding the solid electrolyte 60, through which exhaust gas can pass, they are omitted in the figure.

Constant current is supplied between the electrodes 64 and 66 by constant current source 70 through switch 68, which is rendered on or off in response to a timing signal. In synchronism therewith, voltage proportional to internal resistance r of the solid electrolyte 60 is taken into sample-hold circuit 72. The voltage taken into the circuit 72 is compared with a reference voltage $V_c$ in comparator 80. An output of the comparator 80 is coupled to a base of transistor 74 through resistor 76, whereby the heater 67 is supplied with a heater current $I_h$ by a voltage source $V_B$ in accordance with a difference between the reference $V_c$ and the signal from the sample-hold circuit 72. With this construction, the internal resistance r of the solid electrolyte 60 is controlled so as to be maintained constant. The heater current $I_h$ is detected as voltage $V_h$ appearing across resistor 78.

If the misfire occurs in the engine 12 and unburnt gas is discharged therefrom, the solid electrolyte 60 is exposed to the unburnt gas of low temperature, so that the temperature of the solid electrolyte 60 is reduced and the internal resistance r thereof increases. Then, the heater current $I_h$ is increased and the internal resistance r of the solid electrolyte 60 decreases to be maintained constant.

Figure 13:
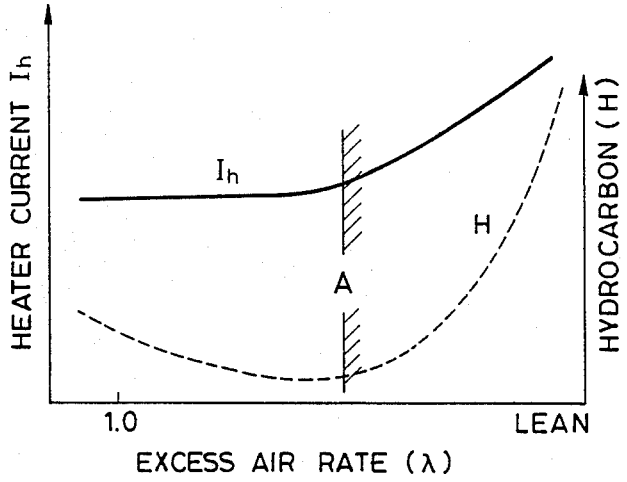
FIG. 13 is a drawing for explaining the operational principle of a fifth embodiment of the present invention.

In this manner, the heater current $I_h$ depends on an amount of unburnt gas discharged. Accordingly, as shown in FIG. 13, the heater current $I_h$ is maintained constant in the stable combustion region, however in the misfiring region, it increases in proportion to the amount of hydrocarbon, which accounts for a considerable portion of the unburnt gas discharged. Similarly to the output voltage of the oxygen sensor 36, therefore, the heater current $I_h$ thereof can be used as a significant marker of detecting the change of the stable combustion limit of the engine 12.

Figure 15:
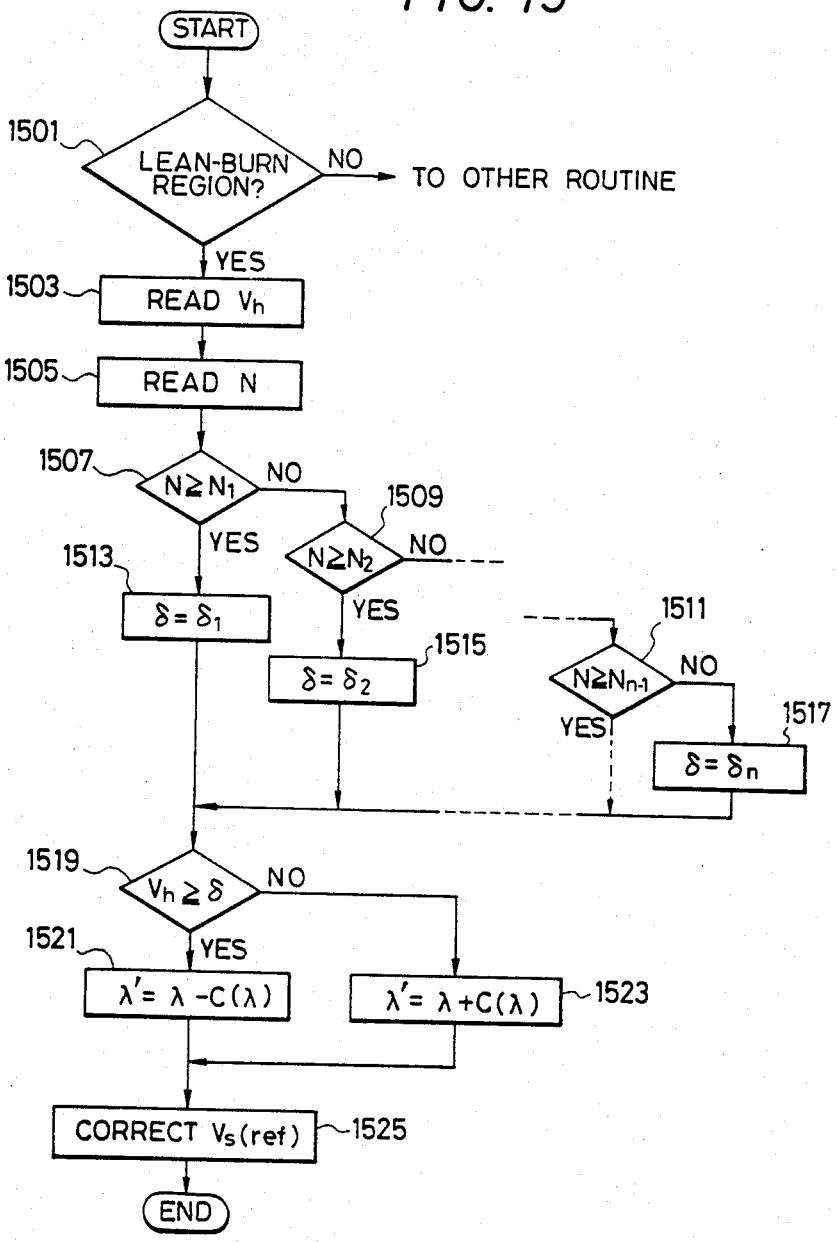
FIG. 15 is a flow chart showing a processing task executed by the microprocessor in FIG. 1 for correcting the reference of the sensor output voltage $V_s$ in accordance with the fifth embodiment.

FIG. 15 shows a flow chart of a processing task executed by the microprocessor 10 in accordance with the present embodiment. At step 1501, it is first judged whether or not the operational state of the engine 12 is in the lean-burn region. If the engine 12 is not operating in the lean-burn region, the operation of the microprocessor 10 is transferred to the execution of a routine for other tasks, and the processing operation of this task ends.

If the engine 12 is operating in the lean-burn region, the voltage $V_h$ proportional to the heater current $I_h$ is read at step 1503. The effect of cooling the sensor portion changes with the velocity of exhaust gas flowing through the exhaust pipe 34, which depends on the number N of revolutions of the engine 12. Therefore, the number N of revolutions of the engine 12 is read at step 1505 and discriminated in the following steps.

In the present embodiment, the discrimination of the number of revolutions is carried out by using n discriminating levels. Namely, there are provided (n−1) of references $N_1, N_2, \ldots, N_{n-1}$ for the number of revolutions, and the comparisons of the read N with those references are carried out at respective steps 1507, 1509, 1511. On the basis of the result of the aforesaid comparisons, one of references $\delta_1, \delta_2, \ldots \delta_n$ is determined at a corresponding step 1513, 1515 or 1517. Then, it is judged at step 1519 whether or not the read $V_h$ is equal to or larger than the reference $\delta$ determined as above.

If $V_h$ is equal to or larger than $\delta$, a new desired excess air rate $\lambda'$ is obtained by subtracting the constant value $C(\lambda)$ from a present desired excess air rate $\lambda$ (cf. step 1521). On the contrary, if $V_h$ does not reach $\delta$, the new desired excess air rate $\lambda'$ is obtained by adding the constant value $C(\lambda)$ to the present desired excess air rate $\lambda$ (cf. step 1523). On the basis of the new desired excess air rate $\lambda'$ obtained as above, a reference $V_s$(ref) for the sensor output voltage $V_s$ is corrected at step 1525, and the processing operation of this task ends.

By the way, after the new desired excess air rate $\lambda'$ is obtained and the reference $V_s$(ref) is determined on the basis of the new desired excess air rate $\lambda'$, the stable combustion limit of the engine 12 may change again. In response to this change in the stable combustion limit, the excess air rate $\lambda$ and accordingly the reference $V_s$(ref) must be changed again. This change can be carried out in the same manner as described above. In this change, however, a further new excess air rate is set by using the new desired excess air rate ($\lambda_b$ or $\lambda_c$) obtained previously as a present desired excess air rate $\lambda$, and a further new reference $V_s$(ref) is determined on the basis of the further new excess air rate.

As described above, according to the present invention, since the degree of misfiring is detected on the basis of a combustion state signal, which can be derived from an oxygen sensor provided in an exhaust pipe of an engine and depends on the amount of unburnt gas discharged. A reference for an output voltage of the oxygen sensor for a feedback control of the A/F ratio is corrected in accordance with the combustion state signal. The aged change in the stable combustion limit can be accurately detected and a new reference for the sensor output voltage is determined at a value very close to the changed stable combustion limit.

With the present invention, even if the stable combustion limit changes toward the rich side, an engine is prevented from misfiring. On the contrary, when the stable combustion limit changes toward the lean side, a desired excess air rate is made larger, whereby the deterioration of the fuel consumption is prevented.

Although there have been herein shown and described some forms of the embodiment of the present invention, it should be understood that various changes and modifications may be made therein within the scope of the appended claims without departing from the spirit and scope of the present invention.

We claim:

1. An apparatus for controlling an air/fuel ratio of fuel mixture to be supplied for an internal combustion engine so as to follow a desired value thereof, comprising:

fuel supply means for supplying a predetermined amount of fuel for the engine in response to a fuel supply signal;

oxygen sensor means, a sensing portion of which is heated at a constant operating temperature, for producing an output voltage in proportion to an air/fuel ratio of fuel mixture supplied for the engine; and microprocessor means, in which the desired value of the air/fuel ratio is set on the basis of load of the engine and a reference of the sensor output voltage is determined in correspondence to the set value of the desired air/fuel ratio, whereby the fuel supply signal is produced so as to make the sensor output voltage actually produced by said oxygen sensor means follow the reference thereof, characterized in that there is further provided means for producing a signal representative of the combustion state in the engine, which is derived from said oxygen sensor means and depends on an amount of unburnt gas discharged from the engine; and said microprocessor means further executes the following steps:

comparing a value of the combustion state signal produced by said signal producing means with a reference value thereof;

changing the value of the desired air/fuel ratio to a new value thereof in accordance with the result of the comparing step; and correcting the reference of the sensor output voltage on the basis of the new value of the desired air/fuel ratio.

2. An air/fuel ratio control apparatus as defined in claim 1, wherein said signal producing means detects an amplitude of a pulsating component included in the sensor output voltage to produce the combustion state signal in proportion thereto.

3. An air/fuel ratio control apparatus as defined in claim 2, wherein the changing step executed by said microprocessor means includes the following steps:

obtaining a difference between the detected amplitude of the pulsating component and a reference value thereof; and changing the desired air/fuel ratio by subtracting a predetermined correction amount from the present value thereof, if the detected amplitude of the pulsating component is larger than a reference value thereof.

4. An air/fuel ratio control apparatus as defined in claim 3, wherein the predetermined correction amount is determined in proportion to the difference between the detected amplitude of the pulsating component and the reference thereof.

5. An air/fuel ratio control apparatus as defined in claim 3, wherein the predetermined correction amount is set at a constant value.

6. An air/fuel ratio control apparatus as defined in claim 2, wherein the changing step executed by said microprocessor means includes the following steps:

obtaining a difference between the detected amplitude of the pulsating component and a reference value thereof;

changing the desired air/fuel ratio by subtracting a first correction amount from a present value thereof, if the detected amplitude of the pulsating component is larger than a reference value thereof; and changing the desired air/fuel ratio by adding a second correction amount to the present value thereof, if the detected amplitude of the pulsating component is smaller than the reference value thereof.

7. An air/fuel ratio control apparatus as defined in claim 6, wherein the first and the second correction amounts are determined in proportion to the difference between the detected amplitude of the pulsating component and the reference thereof.

8. An air/fuel ratio control apparatus as defined in claim 7, wherein a proportion constant for obtaining the first correction amount is larger than a proportion constant for obtaining the second correction amount.

9. An air/fuel ratio control apparatus as defined in claim 6, wherein the first and the second correction amounts are set at constant values.

10. An air/fuel ratio control apparatus as defined in claim 9, wherein the first correction amount is larger than the second correction amount.

11. An air/fuel ratio control apparatus as defined in claim 1, wherein said microprocessor means identifies a particular one of cylinders of the engine, in which the misfire occurs, and changes only the desired air/fuel ratio for the particular cylinder by subtracting a predetermined correction amount from the present value of the desired air/fuel ratio.

12. An air/fuel ratio control apparatus as defined in claim 11, wherein the particular cylinder is identified on the basis of a time duration from a time point, at which if a reference cylinder misfires, the peak value caused by the misfire of the reference cylinder appears in the sensor output voltage, to a time point, at which the peak value actually appears in the sensor output voltage.

13. An air/fuel ratio control apparatus as defined in claim 12, wherein the particular cylinder is identified on the basis of an average value of a plurality of the time durations.

14. An air/fuel ratio control apparatus as defined in claim 11, wherein the predetermined correction amount is determined in proportion to a difference obtained in the comparing step.

15. An air/fuel ratio control apparatus as defined in claim 11, wherein the predetermined correction amount is determined at a constant value.

16. An air/fuel ratio control apparatus as defined in claim 1, wherein said signal producing means detects an amplitude of pulsation in a deviation between an actually detected air/fuel ratio and the desired air/fuel ratio to produce the combustion state signal in proportion thereto.

17. An air/fuel ratio control apparatus as defined in claim 16, wherein the changing step executed by said microprocessor means includes the following steps:

obtaining a difference between a detected amplitude of the pulsating deviation and a reference value thereof; and changing the desired air/fuel ratio by subtracting a predetermined correction amount from the present value of the desired air/fuel ratio, if the detected amplitude of the pulsating deviation is larger than a reference value thereof.

18. An air/fuel ratio control apparatus as defined in claim 17, wherein the predetermined correction amount is determined in proportion to the difference between the detected amplitude of the pulsating deviation and the reference value thereof.

19. An air/fuel ratio control apparatus as defined in claim 17, wherein the predetermined correction amount is determined at a constant value.

20. An air/fuel ratio control apparatus as defined in claim 16, wherein the changing step executed by said microprocessor means includes the following steps:

obtaining a difference between a detected amplitude of the pulsating deviation and a reference value thereof;

changing the desired air/fuel ratio by subtracting a first correction amount from the present value thereof, if the detected amplitude of the pulsating deviation is larger than a reference value thereof; and changing the desired air/fuel ratio by adding a second correction amount to the present value thereof, if the detected amplitude of the pulsating deviation is smaller than the reference value thereof.

21. An air/fuel ratio control apparatus as defined in claim 20, wherein the first and the second correction amounts are determined in proportion to the difference between the detected amplitude of the pulsating deviation and the reference value thereof.

22. An air/fuel ratio control apparatus as defined in claim 21, wherein a proportion constant for obtaining the first correction amount is larger than a proportion constant for obtaining the second correction amount.

23. An air/fuel ratio control apparatus as defined in claim 20, wherein the first and the second correction amounts are determined at constant values.

24. An air/fuel ratio control apparatus as defined in claim 23, wherein the first correction amount is larger than the second correction amount.

25. An air/fuel ratio control apparatus as defined in claim 1, wherein said signal producing means detects heater current, which is supplied for a heater for heating the sensing portion of said oxygen sensor means at the constant operating temperature, to produce the combustion state signal in response thereto.

26. An air/fuel ratio control apparatus as defined in claim 25, wherein the changing step executed by said microprocessor means includes the following steps:

comparing a detected value of the heater current with a reference thereof; and changing the desired air/fuel ratio by subtracting a predetermined correction amount from the present value thereof, if the heater current is larger than a reference value thereof.

27. An air/fuel ratio control apparatus as defined in claim 26, wherein the reference of the heater current is varied in accordance with the number of revolutions of the engine.

28. An air/fuel ratio control apparatus as defined in claim 26, wherein the predetermined correction amount is determined in proportion to the difference between the heater current and the reference value thereof.

29. An air/fuel ratio control apparatus as defined in claim 26, wherein the predetermined correction amount is determined at a constant value.

30. An air/fuel ratio control apparatus as defined in claim 25, wherein the changing step executed by said microprocessor means includes the following steps:

obtaining a difference between a detected value of the heater current and a reference thereof;

changing the desired air/fuel ratio by subtracting a first correction amount from the present value thereof, if the detected heater current is larger than the reference value thereof; and changing the desired air/fuel ratio by adding a second correction amount to the present value thereof, if the detected heater current is smaller than the reference value thereof.

31. An air/fuel ratio control apparatus as defined in claim 30, wherein the reference value of the heater current is varied in accordance with the number of revolutions of the engine.

32. An air/fuel ratio control apparatus as defined in claim 30, wherein the first and the second correction amounts are determined in proportion to the difference between the detected heater current and the reference value thereof.

33. An air/fuel ratio control apparatus as defined in claim 32, wherein a proportion constant for obtaining the first correction amount is larger than a proportion constant for obtaining the second correction amount.

34. An air/fuel ratio control apparatus as defined in claim 30, wherein the first and the second correction amounts are determined at constant values.

35. An air/fuel ratio control apparatus as defined in claim 34, wherein the first correction amount is larger than the second correction amount.

* * * * *